United States Patent [19]

Tanaka et al.

[11] Patent Number: 4,586,664

[45] Date of Patent: May 6, 1986

[54] BEARING SUPPORTING SYSTEM FOR CONE CRUSHER

[75] Inventors: Takeshi Tanaka; Masao Jotatsu, both of Kobe; Masaaki Higaki, Hiroshima; Toshimasa Hamada, Hiroshima; Tadashi Hashikawa, Hiroshima; Toneri Ohashi, Hiroshima; Seigo Togawa, Hiroshima, all of Japan

[73] Assignee: Kabushiki Kaisha Kobe Seiko Sho, Kobe, Japan

[21] Appl. No.: 594,730

[22] Filed: Mar. 29, 1984

[30] Foreign Application Priority Data

Apr. 1, 1983 [JP] Japan ..... 58-49420[U]

[51] Int. Cl.[4] ..... B02C 2/04

[52] U.S. Cl. ..... 241/213; 241/215

[58] Field of Search ..... 241/207–216, 241/286, 290

[56] References Cited

U.S. PATENT DOCUMENTS

| | | | |
|---|---|---|---|
| 2,014,588 | 9/1935 | Rumpel | 241/214 X |
| 2,829,842 | 4/1958 | Messinger | 241/208 |
| 2,970,575 | 2/1961 | Stern . | |
| 3,395,621 | 8/1968 | Peters | 241/211 X |

FOREIGN PATENT DOCUMENTS

| | | |
|---|---|---|
| 2751449 | 12/1978 | Fed. Rep. of Germany . |
| 2731164 | 1/1979 | Fed. Rep. of Germany . |
| 2811585 | 9/1979 | Fed. Rep. of Germany . |

*Primary Examiner*—Howard N. Goldberg
*Assistant Examiner*—Timothy V. Eley
*Attorney, Agent, or Firm*—Oblon, Fisher, Spivak, McClelland & Maier

[57] ABSTRACT

A bearing supporting system for cone crushers of the type which has a head center securely mounted on an upper portion of a main shaft for mounting a mantle thereon and has the main shaft supported by the eccentric drive shaft in radial direction, the support system including a self-aligning thrust bearing mounted on an intermediate portion of the mantle shaft, supporting the main shaft on the eccentric drive shaft through the thrust bearing.

8 Claims, 12 Drawing Figures

(a)

(b)

(c)

(d)

(a)

(b)

BEARING SUPPORTING SYSTEM FOR CONE CRUSHER

BACKGROUND OF THE INVENTION

1. Field of the Invention

This invention relates to a bearing supporting system suitable for cone and gyratory crushers and especially for the so-called spiderless crushers which are designed to support a main shaft assembly with a mantle in a radial direction only at the lower side thereof without requiring bearing support to the upper side thereof. More particularly, the invention concerns a bearing supporting system which has a thrust bearing mounted in an improved manner for supporting a main shaft in the thrust direction, forming a suitable oil film on the bearing surface and ensuring a prolonged lifetime of a crusher.

2. Description of the Prior Art

In general, the crusher is provided with a mantle substantially of a truncated cone shape which is rotatable in an eccentric state within a concave ring substantially in the form of a conical cylinder to crush rocks of feed material by compression between the concave ring and mantle. The main shaft assembly with a mantle is supported by either a double supporting system which is adapted to support the upper and lower sides of the main shaft or by a single supporting system which is adapted to support only a lower side of a mantle shaft in a radial direction, leaving the upper side of the mantle shaft in a free state. The type which supports the upper and lower sides of a mantle shaft can provide a stable support of a simple construction but it requires mounting of radial support arms extending from the upper portion of the main shaft toward a concave ring. These radial support arms are located across a passage of feed material to be fed into the crusher, so that they form obstacles hindering the feed material from being fed freely in all directions. That is to say, the feeding becomes irregular in the circumferential direction, giving rise to a problem of uneven wear of the concave ring and mantle.

In contrast, in the latter case, it is possible to preclude the problem of uneven wear as mentioned above, and to feed material in an extremely smooth manner without creating any obstacle to feeding. However, owing to the cantilever-like support of a main shaft, a large load is imposed on the bearing, so that the bearing support system has to be constructed to endure operations under the conditions of heavy load.

An example of the cone crusher which is constructed to this effect is proposed in the conventional cone crusher in FIG. 1 and in Japanese patent publication No. 57-58216 as illustrated in FIG. 1A. The cone crusher shown in the figures is provided with a casing 1 consisting of an upper casing 3 and a lower casing 2, a concave ring 4 substantially in the form of a conical cylinder which is fitted on the inner surface of the upper casing 3, and a mantle 5 which is rotatably supported in the concave ring 4. The lower casing 2 is integrally provided with a support cylinder 6 at the bottom thereof, the support cylinder 6 having an eccentric drive shaft 8 substantially in the form of a conical cylinder rotatably fitted thereon through a radial bearing 7 fitted on the inner surface of the support cylinder 6.

A main shaft 12 which has the mantle 5 secured thereto through a head center 11 is supported in an upper portion of the eccentric drive shaft 8 rotatably through a radial bearing 13 and in an eccentric and tilted state. A spherical bearing 14 is securely mounted at the upper side of the eccentric drive shaft 8 in sliding contact with a spherical surface 15 formed on the underside of the head center 11.

With this cone crusher, rotation of a drive shaft 16 is transmitted to the eccentric drive shaft 8 through a gear 17 mounted at the fore end of the drive shaft 16 in meshing engagement with a bevel gear 18 on the eccentric drive shaft 8, imparting gyratory rocking motions to the main shaft 12 which is mounted in a tilted state on an upper portion of the eccentric drive shaft 8, by rotation about the axis thereof. Accordingly, the mantle 5 which is mounted coaxially on the mantle shaft 12 through the head center 11 is put in similar gyratory motions eccentrically about the axis of the concave ring 4.

When the mantle is put in such eccentric gyratory motions, rocks which are fed into the clearance between the concave ring 4 and mantle 5, namely, to a crushing chamber 19 is compressed and crushed between the mantle 5 and concave ring 4 by eccentric gyratory motions of the mantle 5. Reaction force F which is produced as a result of compression of the material acts as rotational moment M1 or M2 relative to the main shaft 12 and the eccentric drive shaft 8 which rotatably supports the main shaft 12, and at the same time acts as an axial force pushing the mantle 5 downward. Such rotational moment M1 or the like is set off by the main shaft 12 which is supported in a radial direction by the eccentric drive shaft 8 through the radial bearing 13 and also in an axial direction by the spherical bearing 14, while the axial thrust is absorbed by the spherical bearing 14.

Further, bending moment M1 which is applied to the eccentric drive shaft 8 through the mantle shaft 12 is absorbed by the bearing 7 which supports the eccentric drive shaft 8 in a radial direction, and the axial thrust force is offset by a hydraulic piston 20 which supports a lower portion of the mantle shaft 12.

As is clear from the foregoing description, the rotational moment and thrust force which act on the mantle of the above-described conventional crusher are supported by bearings 7 and 13 in the radial direction in the fashion of a cantilever and by the spherical bearing 14 and hydraulic piston 29 in the axial direction. Accordingly, the bearings are subjected to large reaction forces during the crushing operation and are required to have a sufficiently high load capacity.

Especially, in the conventional crusher of this sort, the main shaft 12 is shrunk-fit on the head center 11 in order to guarantee sufficient strength of the main shaft 12 and the head center 11. However, the head center 11 undergoes deformation on the order of several tens to several hundreds of microns on shrinkage fitting even if the individual units of the head center 11 and main shaft 12 are manufactured with high precision, causing strong localized sliding contact at least either one of the thrust and radial bearings 7, 13 and 14 which are required to absorb thrust or radial loads imposed by the crushing reaction forces through an oil film of several tens of microns in thickness, shortening the lifetime of the bearings.

SUMMARY OF THE INVENTION

It is therefore an object of the present invention to provide a bearing supporting system for a cone crusher, which can eliminate the above-mentioned problems or drawbacks of the conventional cone crushers.

A more particular object of the present invention is to provide a bearing supporting system of the class mentioned above, supporting a main shaft on an eccentric drive shaft tailored to preclude localized abutment of bearing surfaces of the bearing support system.

It is another object of the present invention to provide a bearing support system of the sort mentioned above, employing between an eccentric drive shaft and a main shaft a self-aligning thrust bearing capable of slight deviational movements to maintain parallelism of bearing surfaces.

According to the present invention, there is provided a bearing supporting system for cone crushers of the type having a head center fixedly mounted on an upper portion of a main shaft for supporting a mantle thereon, and an eccentric drive shaft for supporting the main shaft in a radial direction, characterized in that the bearing supporting system essentially comprises a thrust bearing mounted on an intermediate portion of the main shaft, supporting said main shaft on said eccentric drive shaft through the thrust bearing.

In a preferred form of the present invention, the thrust bearing comprises a first member having a circular radially split bearing surface and fixedly mounted on an annular flange formed integrally on an intermediate portion of the main shaft, and a second member having on its upper side a flat bearing surface in abutting engagement with the bearing surface of the first member and on its lower side a spherical surface seated on a fixed spherical seat member at the upper end of the eccentric drive member in a manner to permit slight deviational movements relative to each other.

The above and other objects, features and advantages of the present invention will become apparent from the following description and appended claims, taken in conjunction with the accompanying drawings which show by way of example some preferred embodiments of the invention.

DETAILED DESCRIPTION OF THE PREFERRED EMBODIMENTS

Figure 2:
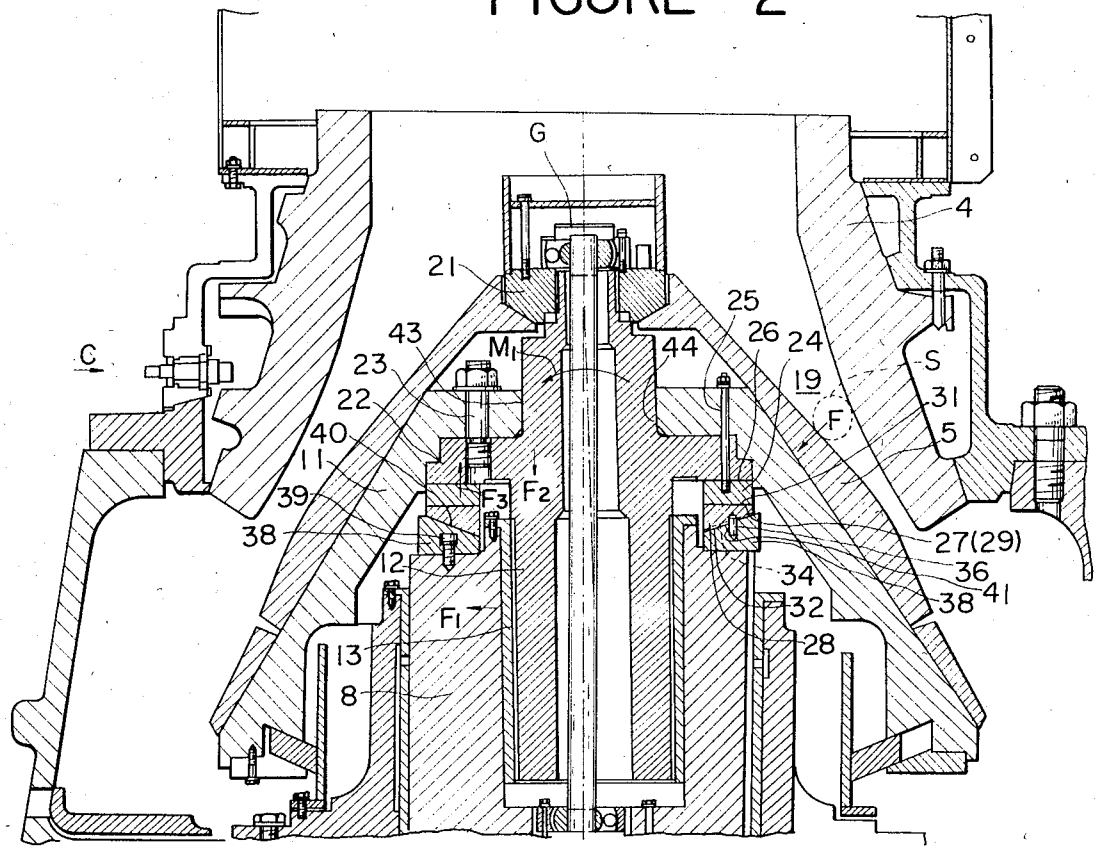
FIG. 2 is a schematic vertical section of a cone crusher incorporating bearing supporting system according to the present invention.

Referring to FIG. 2, there is illustrated a cone crusher employing a bearing support system of the invention, including a mantle 5 which is fixed in position and pressed against a tapered circumferential surface of a head center 11 by a nut 21 which is threaded on the fore end of a main shaft 12. The head center 11 is secured by bolts 23 to a flange 22 which is integrally provided in an intermediate portion of the main shaft 12.

The head center 11 has a mounting hole 44 fitted on an upper shaft portion 43 of the main shaft 12 to ensure its concentricity with the latter. However, it is desirable to mount the main shaft with a strong fit and with light shrinkage in order to enhance the accuracy of fitting of the mounting hole 44 and upper shaft portion 43.

By fitting the head center 11 on the main shaft 12 in the above-described manner and fixing the same in position by bolts, such can be assembled without causing a large distortion thereof nor localized abutment of bearing surfaces as experienced when the head center 11 is shrunk-fitted on the main shaft 12.

Figure 3:
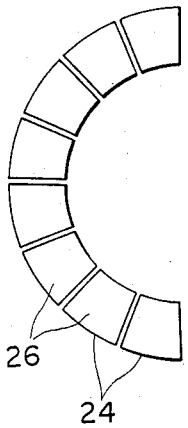
FIGS. 3(*a*) to 3(*d*) are a bottom view, a side view, a top view and a sectional view taken on line A—A of FIG. 3(*c*), respectively showing a number of thrust pads constituting a first member of the thrust bearing of the invention and providing a circular radially split bearing surface.
Figure 3:
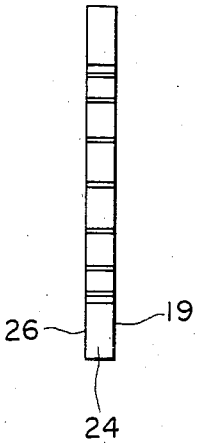
Figure 3:
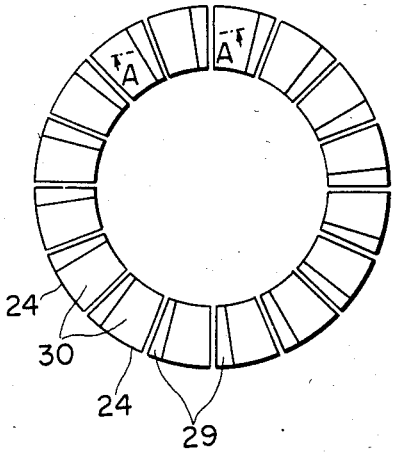
Figure 3:
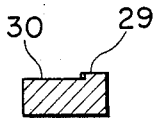

A plurality of radially separated thrust pads 24 are circularly fixedly mounted on the lower side of the flange 22 in an intermediate portion of the main shaft 12 by bolts 25. These thrust pads 24 constitute one member of a thrust bearing, which has a radially divided circular bearing surface, and are each provided, for example, with a flat bottom surface 26, a flat surface 29 on a bearing surface 27 located on the opposite side for abutting engagement with a thrust bearing plate 28, and a flat sunken surface 30 indented from the flat surface 29 toward the bottom surface as shown in FIG. 3. The lubricant oil which is pooled on the flat sunken surface 30 is forcibly fed onto the flat surface 29 in a wedge-like fashion to support a large axial thrust load.

The radially divided annular thrust bearing which is useful in the present invention is not limited to the above-described sunken form, and may have the sunken flat surface and bearing surface 29 connected by a tapered surface to provide the so-called tapered land type thrust bearing or may have the respective pads tiltably mounted independently of each other to form the so-called tilting pad thrust bearing for facilitating intrusion of lubricant oil between the pads and opposing bearing surfaces.

Figure 4:
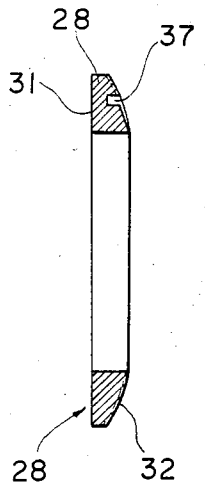
FIGS. 4(*a*) and 4(*b*) as an example are a sectional side view and a bottom view of a thrust bearing plate constituting a second member of the thrust bearing of the invention.
Figure 4:
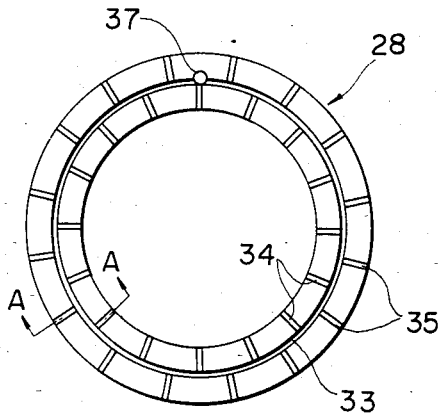

As illustrated particularly in FIG. 4, the thrust bearing plate 28 which is positioned opposingly to the thrust surfaces 29 of the thrust pads 24 is provided with a flat surface 31 on its upper side confronting the thrust pads 24 to ensure smooth contact with the bearing surface 29 of the latter, and with a bottom surface 32 of a downwardly convex shape which is formed with a concentric annular groove and a plurality of radial grooves 34 and 35 for communicating the annular groove with the inner and outer sides of the thrust bearing plate 28. The thrust bearing plate 28 consists of a unitary structure in the circumferential direction thereof and provided with at least a vertically extending pin receiving hole 37 on the convex surface 32 for inserting a straight pin 36.

Figure 5:
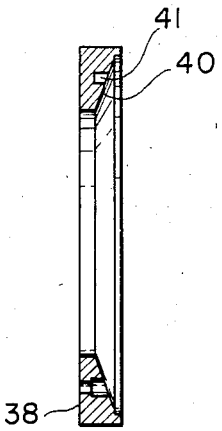
FIGS. 5(*a*) and 5(*b*) are a sectional side view and a top view of a spherical seat member employed in the embodiment of FIG. 2.
Figure 5:
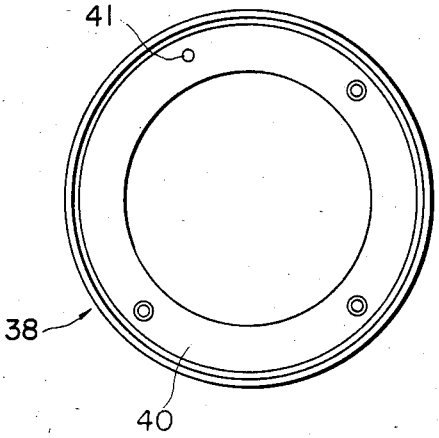

As illustrated in FIG. 2, the eccentric drive shaft 8 which rotatably holds the main shaft 12 in an inclined state within the bearing 13 has an annular spherical seat 38 securely mounted at its upper end by bolts 39 coaxially with the main shaft 12. The upper surface 40 of the spherical seat 38 is formed in a concave spherical surface with a radius of curvature the same as or conforming with the spherical surface 32 of the thrust bearing plate 28 as shown in FIG. 5, with the spherical surface 40 in sliding contact with the spherical surface 32 of the thrust bearing plate 28.

Bored through the spherical surface 40 of the spherical seat 38 is a pin receiving hole 41 in a position coinciding with the inside diameter slightly smaller than the pin receiving hole 37 of the thrust bearing plate 28. These holes 37 and 41 are aligned with each other in the assembled state of the crusher shown in FIG. 2 to receive the pin 36 therein. The pin 36 has an outer diameter which is equal to the inside diameter of the pin receiving hole 41 so that it is held in the pin receiving hole 41 with a strong fit and held loosely in the pin receiving hole 37, permitting slight deviations of the thrust bearing plate 28 relative to the spherical surface 38. Accordingly, the thrust bearing plate 28 is tiltable in an arbitrary direction although through a small angle. By this self-aligning action of the thrust bearing plate 28, its spherical surface 31 allows the bearing surfaces 29 of the thrust pads 24 to maintain perfect parallelism therebetween.

When feed material S is fed in a crushing chamber 19 in a cone crusher which is constructed as in the above-described embodiment, a crushing force F which acts on the mantle 5 produces a force F1 acting to presses the mantle shaft 12 against the radial bearing 13, a thrust force F2 acting to push the mantle shaft 12 downward and a rotational moment M1 acting to rotate the mantle shaft 12 counterclockwise. In this instance, the radial force F1 is supported by the radial bearing 13 and the thrust force F2 is supported by the bearing surfaces 29 and 31 of the thrust bearings 24 and 28, while the rotational moment M1 is absorbed by the force F3 of the bearing surface 29 which tends to push up the thrust pads 24, prohibiting uneven or localized load application on the respective bearing surfaces.

It is important for such thrust structure to prevent localized abutment of each bearing by improving the perpendicularity of the bearing surfaces 27 of the thrust pads 24 relative to the radial bearing 13. In the above-described embodiment, the thrust pads 24 are mounted on the flange 22 which is provided integrally with the main shaft 12, so that it is possible to machine the bearing surface of the radial bearing 13 and thrust pad mounting surface consistently in a manufacturing process, allowing improvement in the perpendicularity of these bearing surfaces to a significant degree.

Since the thrust bearing plate 28 is supported on the spherical seat 38 in such a manner as to permit slight tilting movement of the thrust bearing plate 28 in the foregoing embodiment. Such has desirable self-aligning function to maintain parallelism of the thrust pads 24 with the bearing surface of the thrust bearing plate 28, forming an oil film of good quality in intimate contact therewith to ensure a maximum load capacity as an well as excellent bearing capacity by improvement of the perpendicularity of the bearing surfaces 27 of the thrust pads relative to the radial bearing 13.

Figure 1:
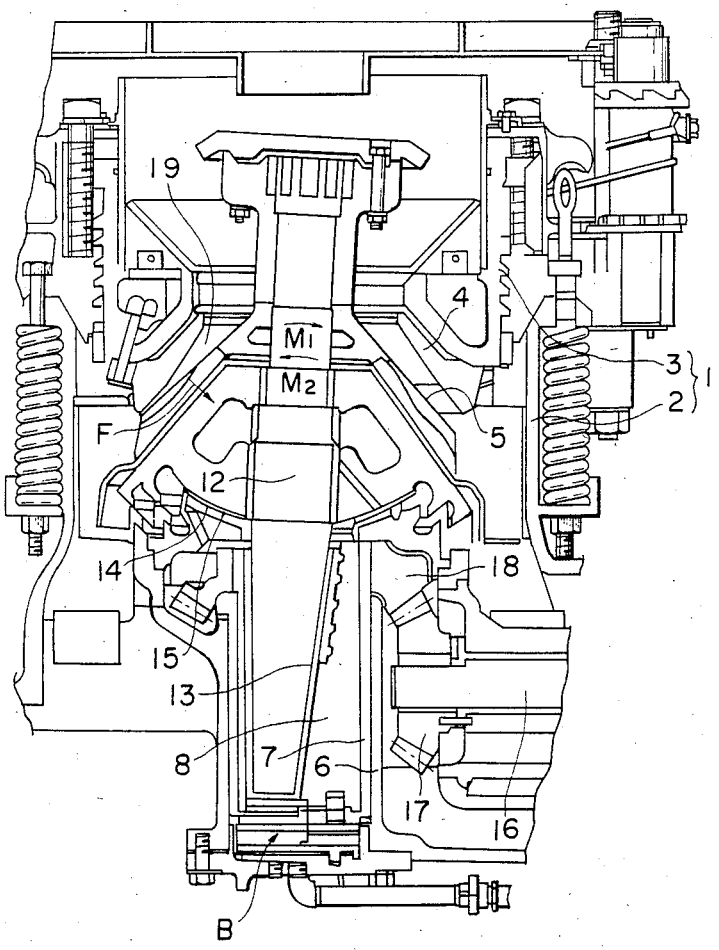
FIGURE 1 PRIOR ART
FIG. 1 is a schematic vertical section of one type of a conventional cone crusher.
Figure 1A:
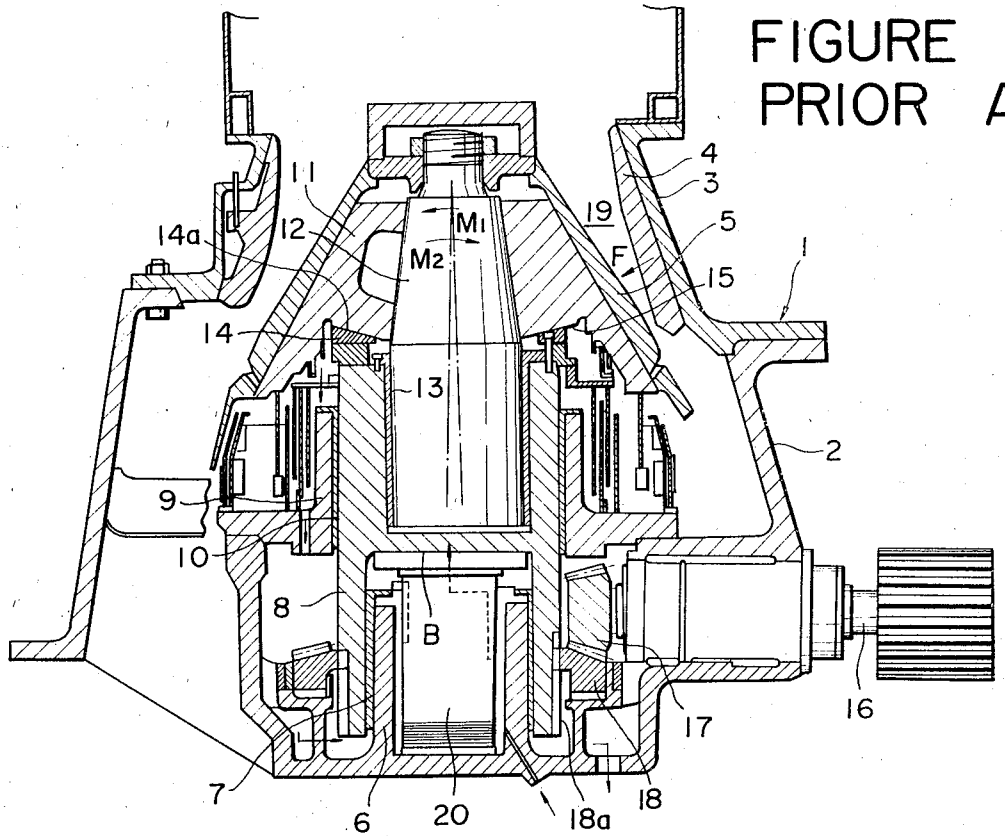
FIGURE 1A PRIOR ART
FIG. 1A is a schematic vertical section of cone crusher according to Japanese patent publication No. 57-58216.
Figure 6:
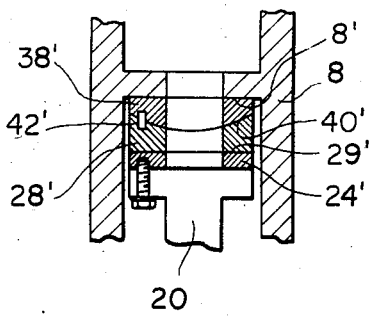
FIG. 6 is a schematic vertical section of a shaft supporting structure applied to an eccentric drive shaft of a cone crusher.

The spherical seat 38 and thrust bearing plate 28 which are connected by the pin 36 which permits slight relative deviations are free of any material frictional wear since they are blocked against relative rotation, and serve not as a spherical bearing but instead as means for producing a self-aligning effect by slight deviations of the thrust bearing plate. The bearing supporting system which is separately provided with a flat thrust bearing surface and self-aligning spherical surface as described hereinbefore can also be applied to the axial contact surface B between the eccentric drive shaft 8 and the hydraulic piston shown in FIG. 1A. More particularly, as shown in FIG. 6, the bearing supporting system may further include thrust pads 24' which are securely mounted on the upper side of the piston 20, and a thrust bearing plate 28' gripped between bearing surfaces 29' of the thrust pads 24' and a spherical surface of a spherical seat 38' which is securely mounted on the underside of the eccentric drive shaft 8. The thrust bearing plate 28' and spherical seat 38' are connected with each other by a pin 42' which permits slight deviations of the thrust bearing plate 28' relative to the latter, thereby supporting the thrust force acting on the eccentric drive shaft 8' and at the same time maintaining parallelism of the thrust pads 24' with the thrust bearing plate 28' by self-aligning action between the spherical seat 38' and the thrust bearing plate 28'.

As is clear from the foregoing description, the present invention is directed to a bearing supporting system for a cone crusher of the type which has a head center securely fixed on an upper portion of a main shaft for mounting a mantle thereon and an eccentric drive shaft for supporting the main shaft in a radial direction, characterized in that the support structure essentially includes a self-aligning thrust bearing mounted on an intermediate portion of the main shaft to support the main shaft on the eccentric drive shaft through the thrust bearing, thereby ensuring perpendicularity of thrust and radial bearing surfaces so as to preclude the problem of localized abutment of the thrust or radial bearing encountered in a conventional cone crusher with a head center secured to a main shaft by shrinkage fitting. Thus, the present invention greatly contributes to improvement of the load capacity of the bearings as well as to prolongation of lifetime of the cone crusher as a whole.

What is claimed is:

1. In a cone crusher, a bearing supporting system, comprising:

a head center securely mounted on an upper portion of a main shaft for supporting a mantle;

an eccentric drive shaft for radially supporting said main shaft;

a thrust bearing mounted on an intermediate portion of said main shaft for supporting said main shaft on said eccentric drive shaft; and a spherical seat member fixedly mounted on said eccentric drive shaft wherein said thrust bearing further comprises a first member having a first bearing surface and a second member having a second bearing surface on an upper side thereof in abutting engagement with said first bearing surface of said first member and a spherical surface on a lower side thereof in abutting engagement with said spherical seat member for permitting relative deviational movements between said thrust bearing and said spherical seat member.

2. The bearing support system as set forth in claim 1, further comprising means for fitting and fixedly securing said head center to said main shaft.

3. The bearing supporting system as set forth in claim 1, wherein said thrust bearing further comprises a circular radially split angular bearing surface.

4. The bearing support system as set forth in claim 1, further comprising an annular flange formed integrally on an intermediate portion of said main shaft, and upon which said thrust bearing is mounted wherein said first member further comprises a plurality of circularly arranged thrust pads.

5. The bearing support system as set forth in claim 1, further comprising a straight pin for connecting said second member of said thrust bearing to said spherical seat member.

6. The bearing support system as set forth in claim 1, wherein said first bearing surface of said first member further comprises a circular radially split bearing surface.

7. The bearing support system as set forth in claim 1, wherein said second bearing surface of said second member further comprises a flat bearing surface.

8. The bearing support system as set forth in claim 1, wherein said first bearing surface of said first member further comprises a circular radially split bearing surface and wherein said second bearing surface of said second member further comprises a flat bearing surface.

* * * * *